US005771761A

United States Patent [19]

Binkowski

[11] Patent Number: 5,771,761

[45] Date of Patent: Jun. 30, 1998

[54] SPRING PIVOTED, RATCHETING LEVER WRENCH

[76] Inventor: Kazimierz M. Binkowski, 17 Riggs St., Ansonia, Conn. 06401

[21] Appl. No.: 632,821

[22] Filed: Apr. 16, 1996

[51] Int. Cl.[6] ..... B25B 13/28

[52] U.S. Cl. ..... 81/99; 81/111; 81/155; 81/167

[58] Field of Search ..... 81/92–100, 106–109, 81/110–111, 126, 129.5, 155, 165–167

[56] References Cited

U.S. PATENT DOCUMENTS

| | | | |
|---|---|---|---|
| 471,940 | 3/1892 | Brink | 81/99 |
| 586,738 | 7/1897 | Hall | 81/109 |
| 1,015,504 | 1/1912 | Meyer | 81/111 |
| 1,634,908 | 7/1927 | Lynch et al. | 81/99 |
| 2,655,064 | 10/1953 | Simon et al. | 81/99 |
| 3,901,106 | 8/1975 | Causey | 81/111 |

FOREIGN PATENT DOCUMENTS

| | | | |
|---|---|---|---|
| 279622 | 11/1927 | United Kingdom | 81/99 |

*Primary Examiner*—D. S. Meislin
*Attorney, Agent, or Firm*—M. P. Williams

[57] ABSTRACT

A wrench includes a fixed jaw (16) at one end of a handle (15) and a pivoted jaw (19) joined to the handle by a pivot (20) disposed in a plane (30). A spring (25) urges the pivoted jaw through a gripping position in which flat gripping surfaces (17, 18) are parallel and separated by a distance which equals the size of the bolthead or nut to be turned. The plane (30) extends through the proximal edges of the surfaces (17, 18) which are flat from the plane to the distal edges of the jaws, and perpendicular to the plane. An auxiliary lever (45) assists in ratcheting. The wrenches may be single ended, double ended, or adjustable, in which case, an integral pivot bar (50) slides within the wrench handle perpendicular to the gripping surfaces (17, 18). A plurality of springs (**25*b*, 25*c***) may be used.

21 Claims, 6 Drawing Sheets

SPRING PIVOTED, RATCHETING LEVER WRENCH

TECHNICAL FIELD

This invention relates to lever wrenches of the type having a fixed jaw attached to a handle and a rotating jaw pivoted to the handle and resiliently urged through a gripping position, such as by a spring.

BACKGROUND ART

In the prior art, there is a large number of types or classes of wrenches which employ rotation between the wrench handle and one of the jaws of the wrench. Some types or classes are principally for operation with pipe or other objects which do not have well-defined opposing flat surfaces, such as bolts and nuts have; some are principally designed for use with bolts and nuts that do have flat parallel opposing surfaces to be gripped; and some are ostensibly useful for either.

There are three functions that can be performed by relative rotation between one jaw which is fixed to the handle and another jaw which is rotatable therewith. The first function is gross adjustability through a wide range of pipe or nut sizes. This type or class of wrench typically has a fixed jaw which is curvilinear (as in U.S. Pat. No. 74,697 and UK Patent 16,524) or provided with a series of small steps (as in German Patent 89,487). These wrenches may be referred to as "cam wrenches". A second feature may resiliently urge the rotating jaw toward a closed position so as to provide ratchetability; that is, rotation of the handle in one direction grips the piece and causes rotation thereof, whereas rotation of the handle in the other direction releases the grip and allows slippage of the wrench to a position for a new purchase on the object being turned. The ratcheting action is demonstrated in FIGS. *7a–7d* of U.S. Pat. No. 4,753,140. Examples of ratcheting cam wrenches are found in U.S. Pat. Nos. 1,900,358, 2,655,064, 2,713,280, and 4,651,597; UK Patents 3,064, 9,137, and 20,392; Australia Patent 148,441; Denmark Patent 70,355; and German Patent 2,205,185. In all of the cam wrenches, the primary feature of adjustability results in other than a good solid, non-damaging grip of opposing flat surfaces of a nut or bolthead. Furthermore, the adjustability means that it is difficult to ratchet upon a particular size of nut or bolt, since the natural wrench action will often span a greater distance than that necessary for the given object being worked on.

A variation in the single pivot type of wrench is a wrench having two pivot points with some sort of sliding action to overcome the aforementioned lack of parallel surfaces for gripping nuts and bolts. Wrenches of this type are shown in U.S. Pat. Nos. 771,451, 1,303,666, 1,486,391, 2,006,073, 5,050,464 and 5,191,816; and French patent 537,961.

Another variation of a spring pivoted lever wrench includes gross adjustability, apart from the variation in jaw opening and not attributable to rotation of one of the jaws. Examples include U.S. Pat. Nos. 1,685,432 and 4,753,140. However, these wrenches have never become popular, probably because the wrenching action itself is ungainly and use of the wrenches is not smooth and comfortable for the user.

Many of the aforementioned wrenches do not have a pivoting jaw which works on a flat edge of a nut or a bolt, but rather grips the corners of the nut or bolt. Examples include the aforementioned U.S. Pat. Nos. 4,651,597 and 5,050,464; and the aforementioned UK patents 3,064 and 9,137. The aforementioned U.S. Pat. No. 2,655,064 ratchets between gripping flat surfaces of the nut or bolthead and gripping the corners of the nut or bolthead, in a 12-point arrangement. However, regardless of how a nut or bolthead is first approached, the wrench must be opened excessively since it cannot be slipped over the parallel sides due to a protrusion on the rotating jaw. This problem exists in a number of the aforementioned wrenches. Whenever there is such a protrusion, not only does the wrench have to be opened more than necessary in order to initially grip a nut or bolthead, but thereafter the action has to be a sliding action along the surfaces of the nut or bolthead before the wrench can properly engage. This sort of action is unnatural and detracts from the usability of the wrench.

Naturally, the cam wrenches have a tendency to wreck the nuts and bolts upon which they are working, and are very ineffective, as any trained mechanic knows.

DISCLOSURE OF INVENTION

Objects of the invention include provision of a ratcheting wrench which is easily engaged with a nut or bolthead, which provides a firm, flat gripping surface on two sides of the nut or bolthead, which does not slip, which ratchets easily with a smooth, rocking motion, and in which the combination of gripping and rotating torque provide effective wrenching action.

This invention is predicated on my discovery that the pivot point between the fixed and moving part of a spring pivoted, ratcheting lever wrench should be on an axis which is as close as possible to a plane that both passes through the actual center of the nut or bolthead being worked and which is perpendicular to the flat surfaces of the nut or bolthead being worked, while not preventing an opening of the wrench jaws by rotation of the pivoted jaw. The pivot point should, therefore, be disposed as close as possible to the fixed jaw of the wrench on an axis which is essentially at the inner limit of the parallel gripping surfaces (the proximal edges) of the two jaws when in the gripping position. Stated alternatively, the pivot should be on an axis which cuts through two corners of the nut or bolthead which are at the inner extremes of the surfaces being gripped. The invention is further predicated on the concept that full, flat surfaces are required for wrenching action, and that there should be no impediment to slipping a bolt or nuthead in between such surfaces when a wrench is first caused to engage a nut or bolthead, or to rocking the wrench in a ratcheting action.

According to the present invention, a spring pivoted, ratcheting lever wrench includes a handle having at a proximal end thereof a first flat surface forming one jaw of the wrench, and having a pivoted jaw with a second flat surface and resiliently urged through a gripping position, the pivot being disposed on an axis within a plane which is perpendicular to the gripping jaw surfaces when said pivoted jaw surface is in a position parallel with said fixed jaw surface so as to tightly grip a nut or bolthead, said plane extending essentially through the edges of said flat surfaces of said jaw proximal to said wrench. The invention may be implemented with a torsion wire spring, a helical tension spring, a plurality of helical tension springs, a helical compression spring, or other spring.

In further accord with the present invention, a secondary lever is provided in the back of the wrench jaw opening to assist in camming hexagonal nuts and boltheads during the ratcheting action.

According to the invention still further, an adjustable, spring pivoted, ratcheting lever wrench has a pivoted jaw which can be extended toward and away from the fixed jaw, the pivot moving with the pivoted jaw along the pivot axis plane which touches the two internal proximal edges of the fixed and moveable jaw flat contact surfaces.

The invention may be implemented with a bifurcated pivoted jaw which extends outside of the fixed jaw and handle, or with a pivoted jaw which fits within a bifurcated fixed jaw and handle. The invention may be implemented with spring pivoted, ratcheting lever wrenches of different sizes on each end of a single handle, or with a single spring pivoted, ratcheting lever wrench on a given handle.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 3:
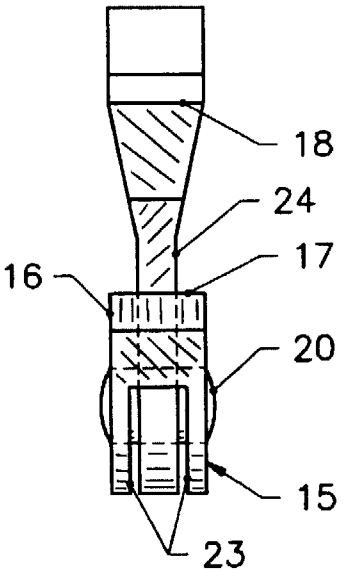
FIG. 3 is an end elevation view of the wrench of FIG. 1.
Figure 1:
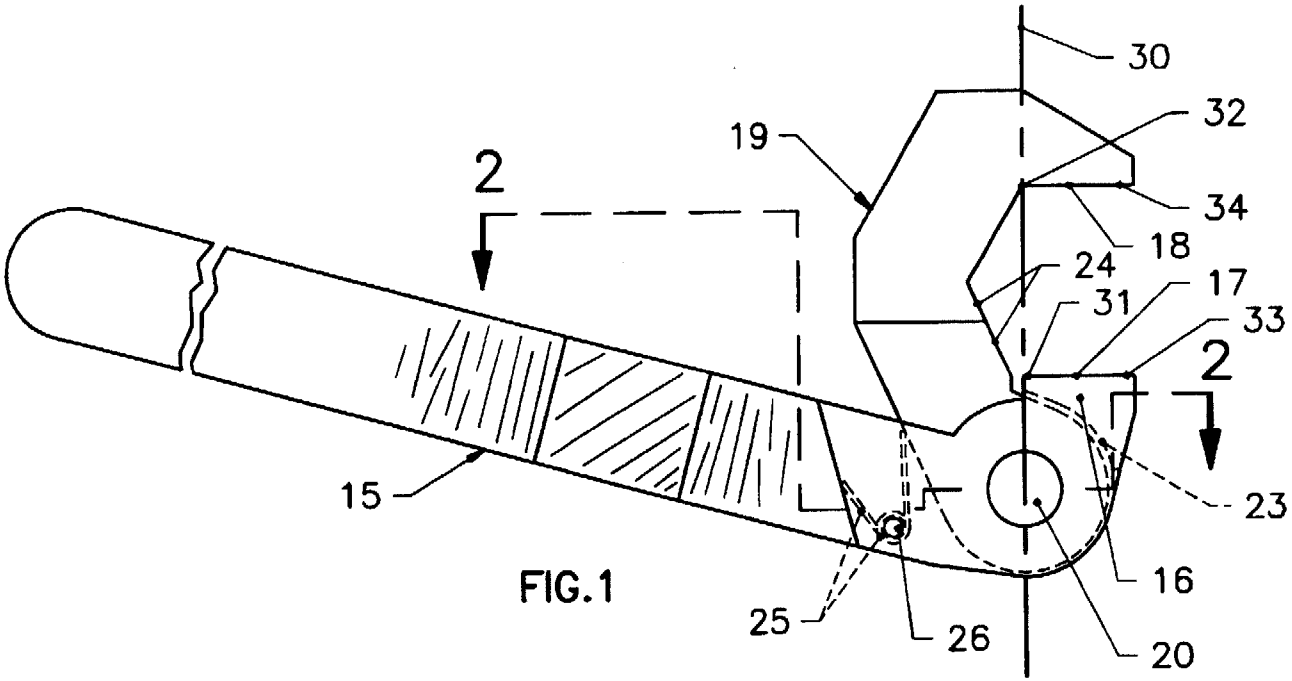
FIG. 1 is a side elevation view of a first, simple embodiment of the present invention.
Figure 2:
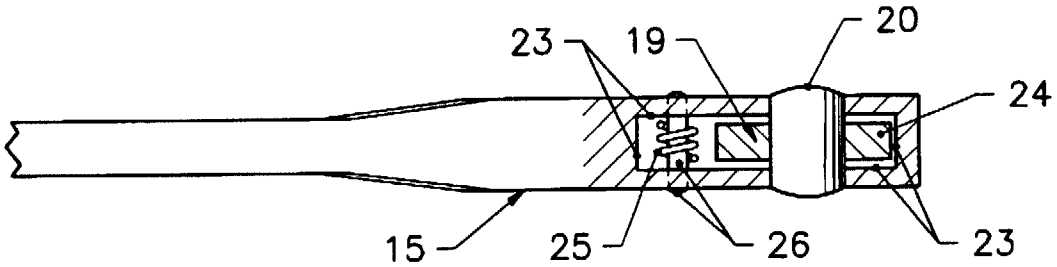
FIG. 2 is a partial, top sectional view taken on the line 2—2 of FIG. 1.

Referring now to FIGS. 1–3, a first, simple embodiment of the invention comprises a handle 15 having a fixed jaw 16 disposed at one end thereof. The fixed jaw 16 has a flat gripping surface 17 which is designed to work with an opposing flat surface 18 of a pivoted jaw 19 which is rotatably mounted to the handle 15 by means of a pivot 20. The handle 15 has a cavity 23 disposed therein to receive a reduced shank portion 24 of the pivoted jaw 19. The cavity 23 also houses a torsion wire spring 25 disposed on a pin 26, which urges the pivoted jaw 19 through the gripping position, in which the surfaces 17, 18 are parallel to each other as shown in FIG. 1, toward a closed position, clockwise in FIG. 1.

The present invention is designed to work with a specific size nut or bolthead, in the same fashion as a box wrench, a socket, or an open-end wrench. However, there is some tolerance, and a wrench of the present invention might be used for similar English and metric sizes, such as a 7/16 inch wrench might work suitably for an 11 millimeter bolthead or nut, a 16 millimeter wrench might work suitably for a 5/8 inch bolthead or nut, and so forth.

In use, the wrench is slipped over the bolthead or nut to be rotated, and the handle 15 turned in a closing direction (counterclockwise in FIG. 1). In accordance with a first aspect of the invention, with a nut fitted essentially parallel between the opposing jaw surfaces 17, 18, counterclockwise rotation of the handle 15 will cause a force which is essentially perpendicular to the opposing jaw surfaces 17, 18. At the surface 18, only a horizontal force will cause rotation of the pivoted jaw 19 about the pivot 20. Therefore, having the jaw surfaces 17, 18 parallel to each other and perpendicular to a plane 30 which passes through the pivotal axis of the wrench means that a compressive force between the jaw surfaces 17 and 18 will not tend to move the pivoted jaw 19 away from the handle 15. Another aspect of the invention is that the proximal edges 31, 32 of the opposing jaw surfaces 17, 18 are essentially in the plane 30 that passes through the pivotal axis of the wrench. A third aspect of the present invention is that the opposing surfaces 17, 18 do not have any protrusions at the distal edges 33, 34 thereof hampering the engagement of the wrench with a bolthead or nut. With the pivoted jaw 19 in the position shown in FIG. 1, such that the opposing jaw surfaces 17, 18 are parallel to one another, the wrench will fit over a nut or bolthead of the size that the wrench is designed to work with, with the opposing surfaces of the nut or bolthead in contact with the surfaces 17, 18, respectively. Then, turning the handle 15 counterclockwise will cause the surfaces 17, 18 to apply compressive force to the opposite faces of the nut or bolthead being turned, and continued rotation of the handle 15 in the counterclockwise direction will cause the bolt or nuthead to turn (if suitable force is applied). After turning the nut or bolthead a desired amount, the handle 15 may be rotated in a counterclockwise direction, which will cause the bottom jaw 17 to rotate with respect to the upper jaw 18, the jaws thereby separating somewhat from the opposing surfaces of the bolthead or the nut allowing the wrench to be turned in a clockwise direction to engage an adjacent pair of opposing surfaces on the bolt or nuthead. This is the ratcheting action that is desirable. The relationship between the opposing jaw surfaces 17, 18, and the plane 30 which passes through the pivotal axis of the wrench as well as the proximal edges 31, 32 thereof, together with the absence of protrusions on the distal edges 33, 34 thereof, cause a nearly purely rotational ratcheting action to be possible, thus rendering the wrench far more easily used than any wrench known in the prior art.

Elements of additional embodiments of a wrench according to the present invention which are exactly the same as those in FIGS. 1–3 bear the same reference numerals, but elements which are modified somewhat from those in FIGS. 1–3 bear a letter suffix.

Figure 5:
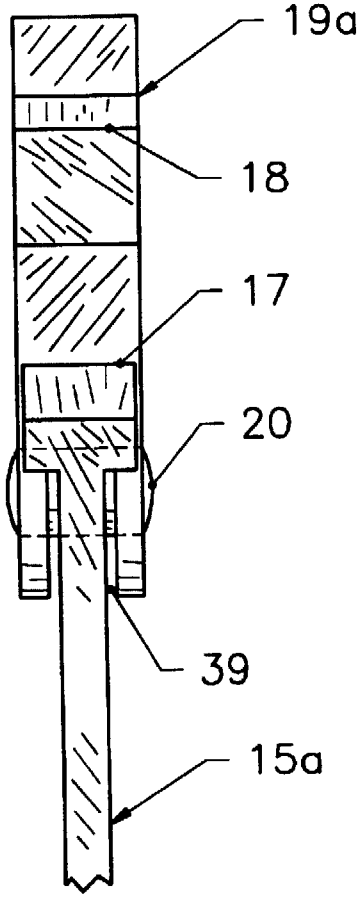
FIG. 5 is a partial end elevation view of the wrench of FIG. 4.
Figure 4:
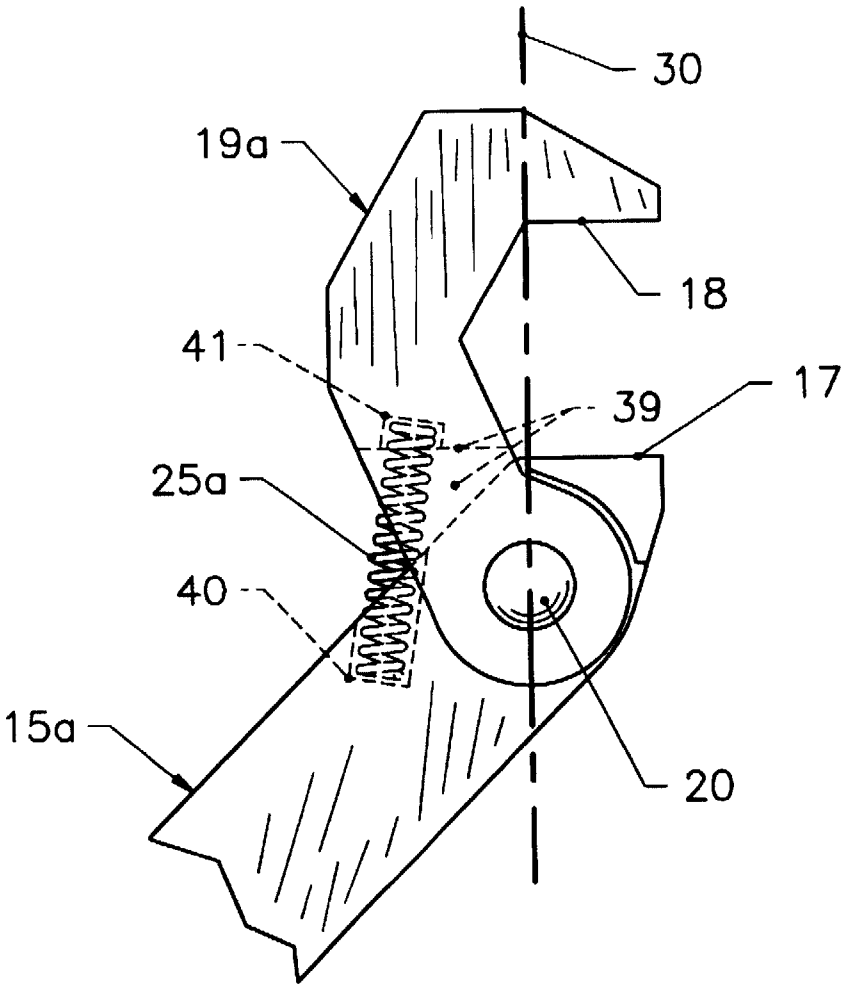
FIG. 4 is a partial side elevation view of a second embodiment of the invention.

In FIGS. 4 and 5, a cavity 39 is formed by bifurcations in the pivoted jaw **19*a*, the handle 15*a* being solid and fitting therewithin. A compression coil spring 25*a* is lodged between a recess 40 in the handle 15*a* and an opposing recess 41 in the pivoted jaw 19*a* to urge the pivoted jaw 19*a*** through the gripping position.

Figure 7:
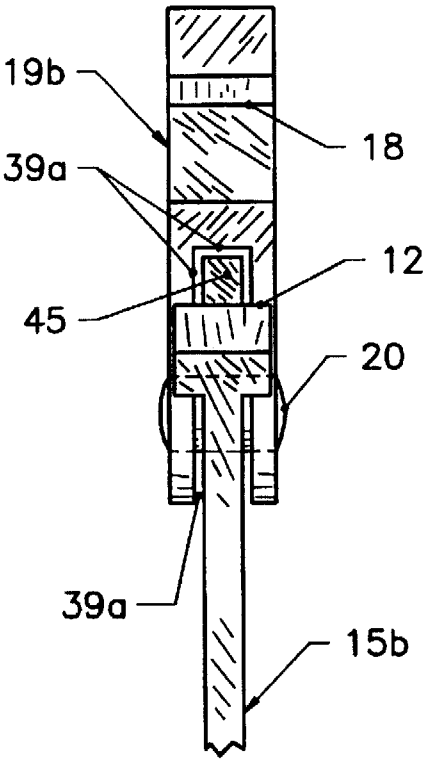
FIG. 7 is a partial, end elevation view of the wrench of FIG. 6.
Figure 6:
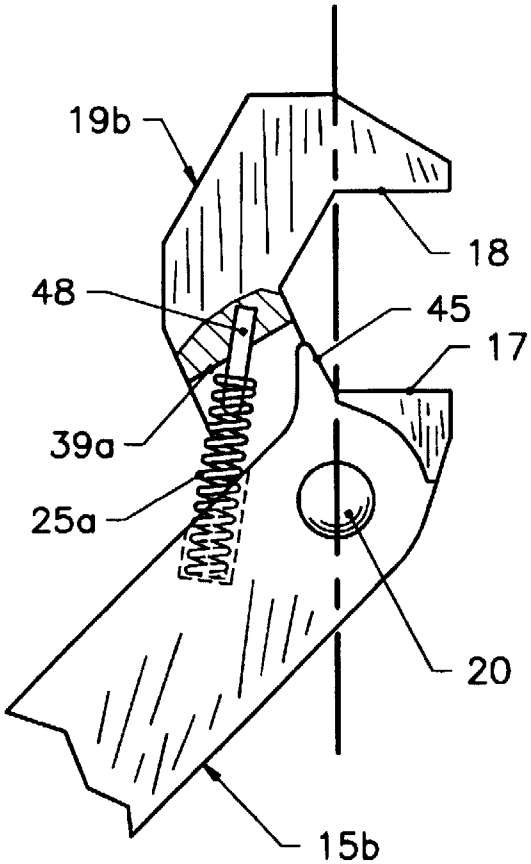
FIG. 6 is a partial, side elevation view of the embodiment of FIG. 4 modified to include a secondary lever of the invention.
Figure 8:
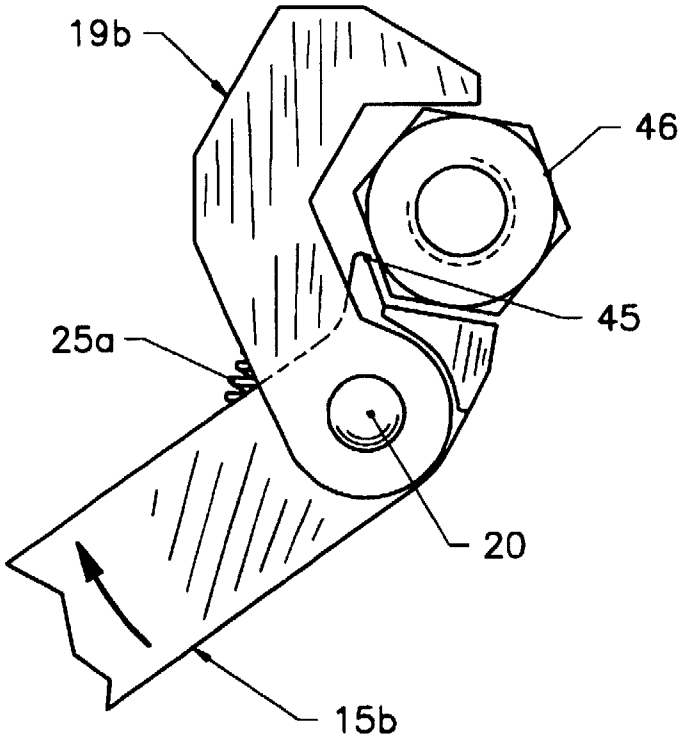
FIG. 8 is a partial side elevation view of the wrench of FIG. 6 with the handle thereof rotated in the ratcheting direction.

As shown in FIGS. 6–8, another aspect of the present invention includes the provision of a secondary lever 45 which assists in the ratcheting action, by tending to push a nut 46 clockwise with respect to the pivoted jaw **19*b* when the handle 15*b* is rotated clockwise during ratcheting, as shown in FIG. 8. The recess 39*a* may be extended to make clearance for the secondary lever 45, and the spring 25*a* may, in that case, be secured to the pivoted jaw 19*b* by means of a pin 48 set into a hole in the edge of the recess 19*a***.

Figure 9:
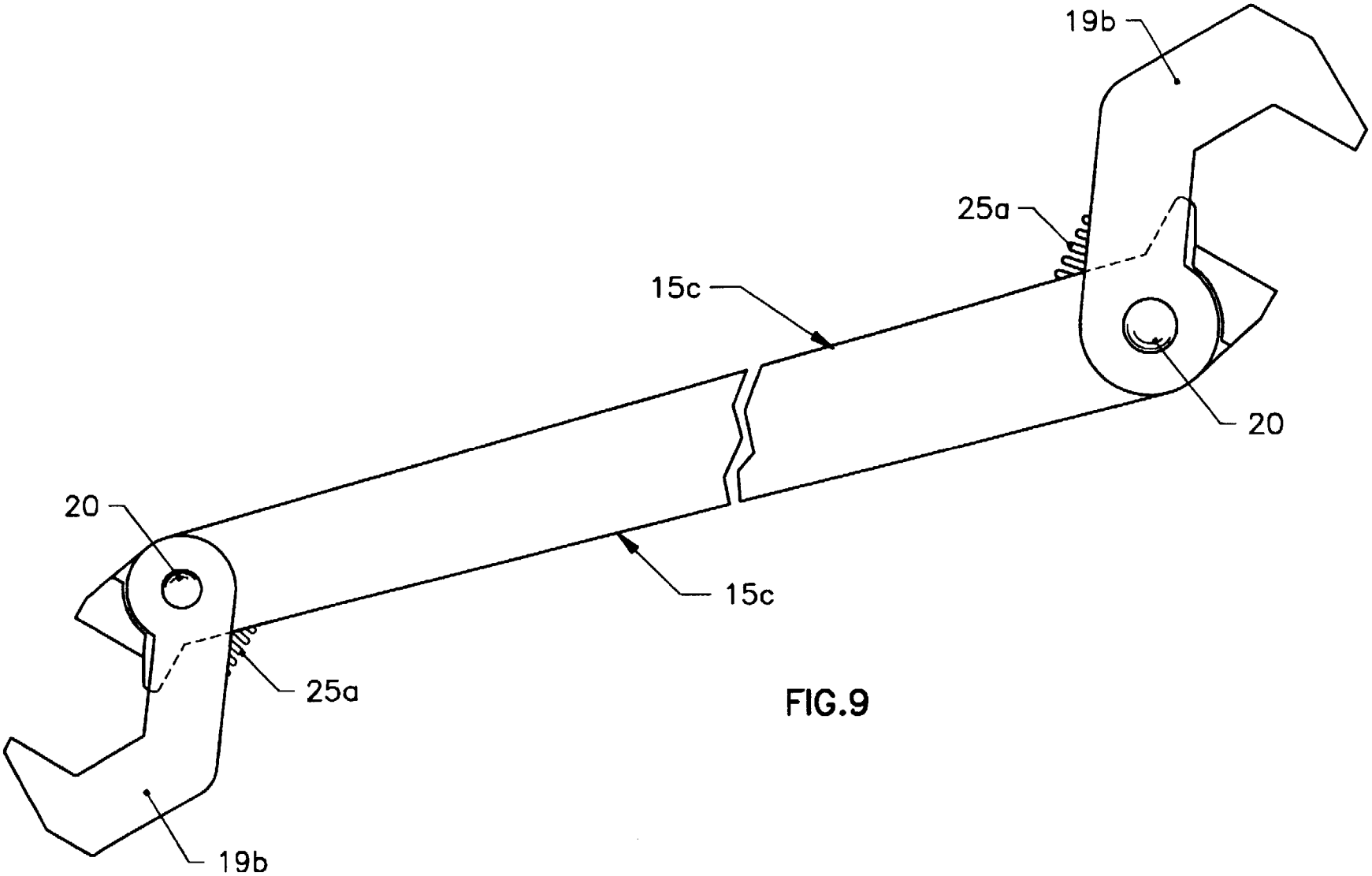
FIG. 9 is a front elevation view of a pair of wrenches of the type shown in FIGS. 6–8 disposed on a single handle.
Figure 11:
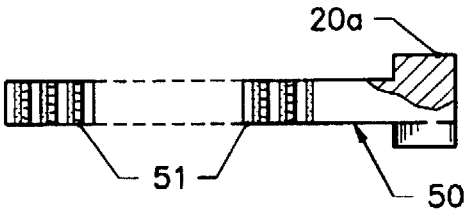
FIG. 11 is a partially sectioned end elevation view of a pivot bar of the wrench of FIG. 10.

FIG. 9 illustrates a handle **15*c* having a different size pivoted jaw 19*b*** forming a spring pivoted ratcheting lever wrench on either end thereof. As in the case of box wrenches and open end wrenches, the wrench on one end may be a size smaller than the wrench on the other end, such as ½ inch and 9/16 inch.

Figure 10:
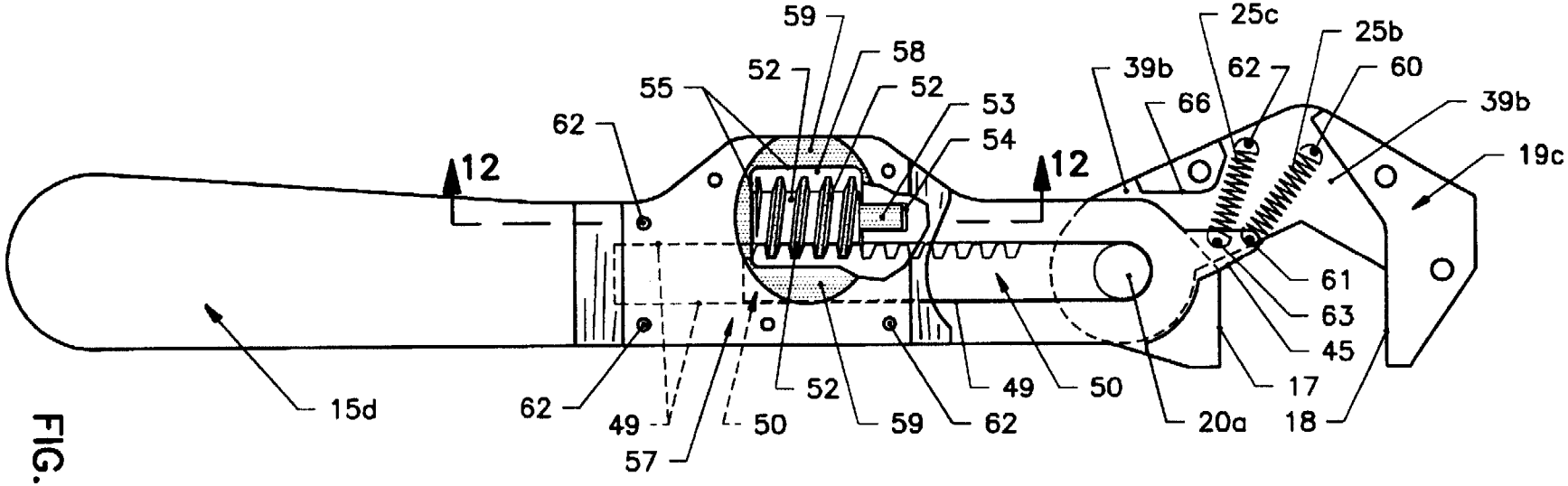
FIG. 10 is a partially broken away, side elevational view of an adjustable wrench in accordance with the present invention, with half of the pivoted jaw removed.
Figure 14:
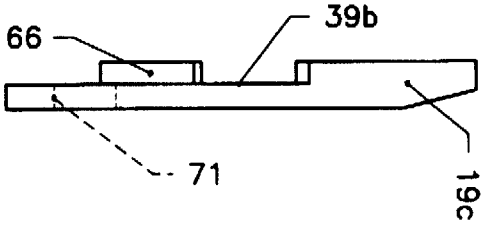
FIG. 14 is an end elevation view of that half of the pivoted jaw illustrated in FIG. 10.
Figure 15:
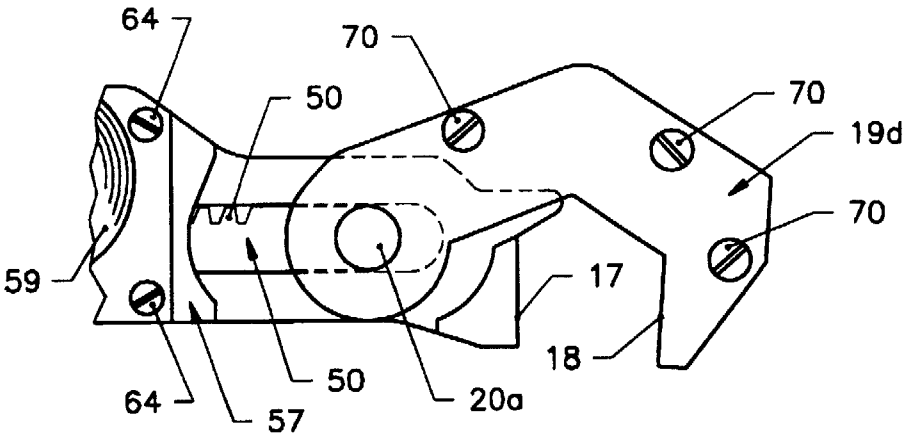
FIG. 15 is a partial side elevation view of the wrench of FIG. 10, showing the other half of the pivoted jaw, with the jaw opening adjusted to a smaller position than that shown in FIG. 10, and with the pivoted jaw rotated through the gripping position up against a stop.
Figure 13:
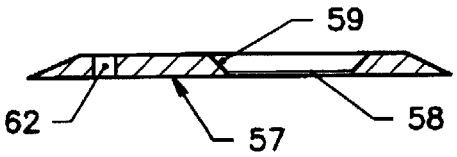
FIG. 13 is a sectioned end elevation view of a cover plate for the wrench of FIG. 12.
Figure 12:
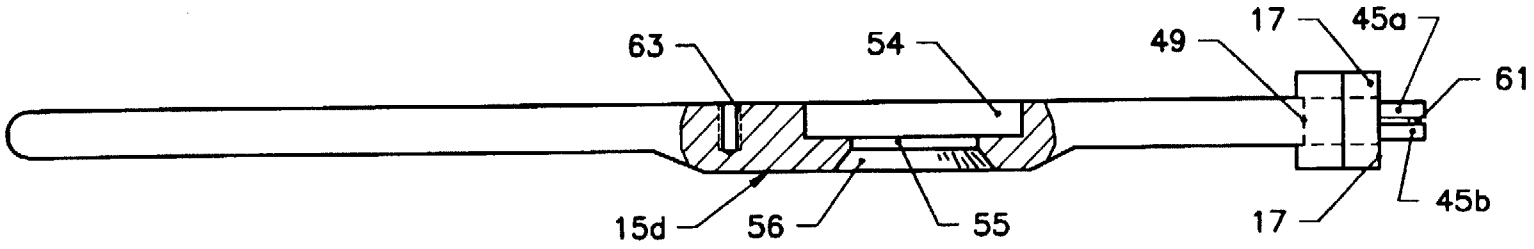
FIG. 12 is a side elevation view, partially sectioned along the line 12—12 of FIG. 10, with a cover plate removed.

In the embodiment of FIGS. 10–14, the handle **15*d* has an elongated slot 49 formed therein within which a generally T-shaped pivot bar 50 is free to slide. The pivot 20*a* is integrally formed at one end of the pivot bar 50, as seen clearly in FIG. 11. The pivot bar 50 has teeth 51 forming a rack which cooperates with an intermeshed worm gear 52 to adjust the position of the pivot bar 50 with respect to the surface 17 of the fixed jaw on the handle 15*d*, as may be seen by comparison of FIG. 15 with FIG. 10. The worm gear 52 may be journaled on a pin 53 disposed in a recess 54. Access to the worm gear 52 by a thumb or finger may be had through a square hole 55 which has a chamfer 56. A cover plate 57, shown in FIGS. 10 and 13, has a similar square hole 18 with an oval chamfer 59. The cover plate 57 serves to retain the pivot bar 50 and the worm gear 52 within the handle 15*d*. The cover plate 57 may be secured to the handle 15*d* by means of screws 64 (FIG. 15) through suitable holes 62, into the threaded holes 63 in the handle 15*d* (FIG. 12). Or, the handle 15*d* can be drilled clear through for use of rivets, bolts or the like. The pivoted jaw is formed from two halves 19*c* (FIG. 10) and 19*d* (FIG. 15). The two halves may be mirror images of each other. In FIG. 10, a recess 39*b* in each half provides clearance for a pair of springs which are stretched between related pairs of pins 60, 61 and 62, 63, respectively. The pins 60, 62 are disposed between the pivoted jaw halves 19*c*, 19*d* and the pins 61 and 63 extend between bifurcations 45*a*, 45*b* (FIG. 12) of the secondary lever 45**.

In FIG. 10, a surface 66 in each half **19*c*, 19*d* of the pivoted jaw prevents the pivoted jaw from rotating too far toward the closed position as a result of the springs 60, 62. The resulting maximum closed position is approximately as shown in FIG. 15. This just assures that the pivoted jaw does not become sufficiently closed to render it difficult to slip the wrench over a bolthead or nut. In this embodiment, the springs 25*b*, 25*c* may have different tension or spring constant so as to alter the spring action as the pivoted jaw moves to accommodate different size nuts. In fact, one of the springs may comprise a pair of springs disposed coaxially so as to provide additional pull between one of the pairs of pins 60, 61 or 62, 63, or both. The particular arrangement of the springs 25*b*, 25*c* may be altered; it is anticipated that, over time, an optimal position may be determined for one or more springs in a wrench of the type shown in FIGS. 10–15. The pivoted jaw half 19*d* may be secured to the pivoted jaw half 19*c* by means of screws 70, or rivets, or the like. As seen in FIG. 14, both of the pivoted jaw halves 19*c*, 19*d* have a hole 71 which is a clearance fit for the pivot 20*a***.

The flat surfaces 17, 18 may have serrations in the nature of teeth thereon, provided they are relatively small; as used herein, the term "flat surface" therefore means any surface having an average planar configuration, including those with serrations. However, in a gripping wrench of the type disclosed herein, flat surfaces without serrations are preferred.

The plane 30 is described herein as extending through the proximal edges 31, 32 of the flat surfaces 71, 18. As used herein, that definition includes situations in which the surfaces 17, 18, or either one of them, may be truncated somewhat so as not to extend completely to the plane 30. The aforesaid description is intended to include the general situation where the plane extends through what would be the proximal corner edges of a nut or bolthead when being gripped in a position that is as far within the wrench as possible.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

I claim:

1. A spring pivoted, ratcheting lever wrench for use in gripping opposed parallel flat surfaces of a bolthead or nut which are separated by a distance defining the size of said bolthead or nut, and rotating said bolthead or nut, comprising:

a handle having two ends and a fixed jaw disposed at one end thereof, said fixed jaw having a first flat surface:

a pivoted jaw having a second flat surface, said pivoted jaw joined to said handle near said one end by a pivot and rotatable through a gripping position in which said second surface is parallel to said first surface and spaced therefrom by said distance:

said first and second surfaces each having a proximal edge near said pivot and a distal edge opposite to the respective one of said proximal edges, said distal edges being the extreme distal edges of said jaws, respectively; and means resiliently urging said pivoted jaw to rotate in a direction to bring said second surface closer to said first surface:

characterized by the improvement comprising:

the axis of said pivot being within a plane which includes the respective proximal edges of said first and second flat surfaces when in said gripping position and which is perpendicular to said first flat surface, said first flat surface extending from said plane to the extreme distal edge of said fixed jaw, and said second flat surface extending from said plane to the extreme distal edge of said pivoted jaw, thereby providing a nut or bolthead with unimpeded access to the space between said first and second flat surfaces when said pivoted jaw is rotated to a position in which said second surface is parallel with said first surface; and a secondary lever extending from the proximal edge of said first surface generally toward said second surface in a position to engage a flat surface of a bolthead or nut when said bolthead or nut is engaged by said first flat surface.

2. A wrench according to claim 1 wherein said pivot is slidable along said handle within said plane, thereby to adjust the distance between said flat surfaces when in the gripping position, thereby to render said wrench adjustable to fit boltheads and nuts of a variety of sizes.

3. A wrench according to claim 2 wherein said pivot is connected to a rack which is slidable along said handle; and comprising:

a worm gear journaled in said handle in engagement with said rack, rotation of said worm gear adjusting the size of said wrench.

4. A wrench according to claim 3 wherein said pivot is formed integrally with said rack.

5. A wrench according to claim 1 wherein said means comprises a torsion wire spring.

6. A wrench according to claim 1 wherein said means comprises a helical compression spring.

7. A wrench according to claim 1 wherein said means comprises a helical tension spring.

8. A wrench according to claim 1 wherein said means comprises a plurality of springs.

9. A wrench according to claim 1 wherein said means comprises a plurality of helical tension springs.

10. A wrench according to claim 1 wherein said handle includes a recess in the vicinity of said pivot for receiving said pivoted jaw.

11. A wrench according to claim 1 wherein said pivoted jaw is bifurcated in the vicinity of said pivot for receiving said handle.

12. A wrench according to claim 11 wherein said pivoted jaw is formed of two mirror-image pieces joined together.

13. An adjustable, spring pivoted, ratcheting lever wrench for use in gripping opposed parallel flat surfaces of boltheads or nuts which are separated by different distances defining the respective sizes of said boltheads or nuts, and rotating said boltheads or nuts, comprising:

a handle having two ends and a fixed jaw disposed at one end thereof, said fixed jaw having a first flat surface;

a pivot disposed in said handle near said one end, the position of said pivot being adjustable along said handle;

a pivoted jaw having a second flat surface, said pivoted jaw joined to said handle by said pivot and rotatable through a gripping position in which said second surface is parallel to said first surface and spaced therefrom by a selectable distance;

said first and second surfaces each having a proximal edge near said pivot and a distal edge opposite to the respective one of said proximal edges, said distal edges being the extreme distal edges of said jaws, respectively; and means resiliently urging said pivoted jaw to rotate in a direction to bring said second surface closer to said first surface;

characterized by the improvement comprising:

the axis of said pivot at different positions within said handle remaining within a plane which includes the respective proximal edges of said first and second flat surfaces when in said gripping position and which is perpendicular to said first flat surface, said first flat surface extending from said plane to the extreme distal edge of said fixed jaw, and said second flat surface extending from said plane to the extreme distal edge of said pivoted jaw, thereby providing a nut or bolthead with unimpeded access to the space between said first and second flat surfaces when said pivoted jaw is rotated to a position in which said second surface is parallel with said first surface; and a secondary lever extending from the proximal edge of said first surface generally toward said second surface in a position to engage a flat surface of a bolthead or nut when said bolthead or nut is engaged by said first flat surface.

14. A wrench according to claim 13 wherein said pivot is connected to a rack which is slidable along said handle; and comprising:

a worm gear journaled in said handle in engagement with said rack, rotation of said worm gear adjusting the size of said wrench.

15. A wrench according to claim 14 wherein said pivot is formed integrally with said rack.

16. A wrench according to claim 13 wherein said means comprises a helical tension spring.

17. A wrench according to claim 13 wherein said means comprises a plurality of springs.

18. A wrench according to claim 13 wherein said means comprises a plurality of helical tension springs.

19. A wrench according to claim 13 wherein said handle includes a recess in the vicinity of said pivot for receiving said pivoted jaw.

20. A wrench according to claim 13 wherein said pivoted jaw is bifurcated in the vicinity of sid pivot for receiving said handle.

21. A wrench according to claim 13 wherein said pivoted jaw is formed of two mirror-image pieces joined together.

* * * * *